US009427983B2

(12) United States Patent
Kamitani et al.

(10) Patent No.: US 9,427,983 B2
(45) Date of Patent: Aug. 30, 2016

(54) SIMPLEX AND DUPLEX PRINTER

(71) Applicant: DAI NIPPON PRINTING CO., LTD., Tokyo (JP)

(72) Inventors: Nobuyuki Kamitani, Tokyo (JP); Katsuhisa Ono, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 14/432,837

(22) PCT Filed: Dec. 25, 2013

(86) PCT No.: PCT/JP2013/084640

§ 371 (c)(1),
(2) Date: Apr. 1, 2015

(87) PCT Pub. No.: WO2014/104084

PCT Pub. Date: Jul. 3, 2014

(65) Prior Publication Data

US 2015/0298472 A1 Oct. 22, 2015

(30) Foreign Application Priority Data

Dec. 28, 2012 (JP) ..... 2012-288648

(51) Int. Cl.
*B41J 11/66* (2006.01)
*B41J 2/325* (2006.01)
(Continued)

(52) U.S. Cl.
CPC ..... *B41J 11/66* (2013.01); *B41J 2/325* (2013.01); *B41J 3/60* (2013.01); *B41J 11/007* (2013.01);
(Continued)

(58) Field of Classification Search
CPC ..... B41J 11/02; B41J 11/04; B41J 11/053; B41J 11/057; B41J 11/06; B41J 11/08; B41J 11/10; B41J 11/13; B41J 11/007; B41J 25/304; B41J 25/308; B41J 25/3082; B41J 25/3084; B41J 25/3086; B41J 25/3088; B41J 25/312; B41J 25/316
USPC ..... 347/220, 221, 222, 197, 198, 104, 171, 347/16; 400/621, 621.1, 633, 636; 83/162, 83/438
See application file for complete search history.

(56) References Cited

U.S. PATENT DOCUMENTS

2007/0030299 A1* 2/2007 Izuchi ..... B41J 3/60 347/16
2014/0071194 A1 3/2014 Inokuchi

FOREIGN PATENT DOCUMENTS

JP 11-249346 A1 9/1999
JP 2004-279603 A1 10/2004
(Continued)

OTHER PUBLICATIONS

English Translation of International Preliminary Report on Patentability (Application No. PCT/JP2013/084640) dated Jun. 30, 2015.
International Search Report (Application No. PCT/JP2013/084640) dated Apr. 8, 2014 (with English translation).

*Primary Examiner* — Kristal Feggins
(74) *Attorney, Agent, or Firm* — Burr & Brown, PLLC

(57) ABSTRACT

There is provided a compact simplex and duplex printer which can be produced easily at a low cost. The simplex and duplex printer includes: a thermal head for performing printing on a substrate; a rolled substrate supply section for supplying a continuous substrate, which is to be printed on one side, to the thermal head; and a sheet-like substrate supply section, provided below the rolled substrate supply section, for sequentially supplying sheet-like substrates, which are to be printed on both sides, to the thermal head. A reversing mechanism for reversing a sheet-like substrate which has been returned from the thermal head is disposed between the thermal head and the sheet-like substrate supply section. The reversing mechanism is disposed just below the rolled substrate supply section.

6 Claims, 10 Drawing Sheets

(51) Int. Cl.

| | |
|---|---|
| ***B41J 3/60*** | (2006.01) |
| ***B41J 13/00*** | (2006.01) |
| ***B65H 85/00*** | (2006.01) |
| ***B41J 11/00*** | (2006.01) |

(52) U.S. Cl.
CPC ..... *B41J 13/0045* (2013.01); *B65H 85/00* (2013.01); *B65H 2301/33214* (2013.01); *B65H 2301/33312* (2013.01)

(56) References Cited

FOREIGN PATENT DOCUMENTS

| | | | |
|---|---|---|---|
| JP | 2007-038562 | A1 | 2/2007 |
| JP | 2008-189411 | A1 | 8/2008 |
| JP | 2010-241029 | A1 | 10/2010 |
| JP | 2011-093255 | A1 | 5/2011 |
| JP | 2014-055042 | A1 | 3/2014 |

* cited by examiner

SIMPLEX AND DUPLEX PRINTER

BACKGROUND OF THE INVENTION

1. Field of the Invention

The present invention relates to a printer for performing printing on a sheet-like substrate or a continuous substrate by the heat of a thermal head, and more particularly to a simplex and duplex printer capable of performing simplex/duplex printing on a substrate.

2. Description of Related Art

A dye sublimation printer, which performs printing by feeding a substrate, having a receptive layer on both sides, from a roll of the substrate, and transferring a dye or a pigment onto the substrate by heating a thermal head, is known as a printer for performing duplex printing.

In such a dye sublimation printer, a roll of substrate is held in a holding section; the holding section is rotated to reverse the substrate, which is fed from the roll of substrate, so as to perform duplex printing. The substrate after printing is cut to obtain a printed sheet-like substrate.

PRIOR ART DOCUMENT

Patent Document

Patent document 1: Japanese Patent Laid-Open Publication No. 2011-93255

SUMMARY OF THE INVENTION

Problems to be Solved by the Invention

As described above, a technique for performing duplex printing on a substrate while feeding the substrate from a roll of substrate has been developed. However, there is a demand for a printer which uses a pre-cut sheet-like substrate and performs duplex printing on the sheet-like substrate while transporting the substrate by means of a transport mechanism and reversing the substrate. A compact and inexpensive simplex/duplex printer will be achieved if such a mechanism for performing duplex printing on a sheet-like substrate can be incorporated into an existing simplex printer.

The present invention has been made in view of the above situation. It is therefore an object of the present invention to provide a simplex and duplex printer which can easily reverse a sheet-like substrate to perform duplex printing on the substrate and which, by incorporating such a duplex printing mechanism into an existing simplex printer, can be made compact and obtained at a low cost.

Means for Solving the Problems

The present invention provides a simplex and duplex printer comprising: a printing section; a rolled substrate supply section for supplying a continuous substrate, which is to be printed on one side, from a roll of the substrate to the printing section; a sheet-like substrate supply section, provided below the rolled substrate supply section, for storing sheet-like substrates which are to be printed on both sides, and sequentially supplying the sheet-like substrates to the printing section; and a reversing mechanism, disposed between the printing section and the sheet-like substrate supply section, for reversing a sheet-like substrate, which has been returned from the printing section, so that the printing section-facing surface changes from one surface to the other surface.

In a preferred embodiment of the present invention, the reversing mechanism reverses the sheet-like substrate, which has been returned from the printing section, while allowing the sheet-like substrate to travel in one direction.

In a preferred embodiment of the present invention, a continuous substrate cutter for cutting the continuous substrate is provided on the exit side of the printing section.

In a preferred embodiment of the present invention, the reversing mechanism is provided with a sheet-like substrate cutter for cutting the sheet-like substrate.

In a preferred embodiment of the present invention, the reversing mechanism is located just below the continuous substrate supply section.

Advantageous Effects of the Invention

According to the present invention, a compact and inexpensive simplex and duplex printer can be obtained by incorporating a duplex printing mechanism, which performs duplex printing on a sheet-like substrate, into an existing simplex printer.

DETAILED DESCRIPTION OF THE INVENTION

A preferred embodiment of the present invention will now be described with reference to the drawings.

FIGS. 1 through 10 are diagrams illustrating a simplex and duplex printer according to an embodiment of the present invention.

Figure 1:
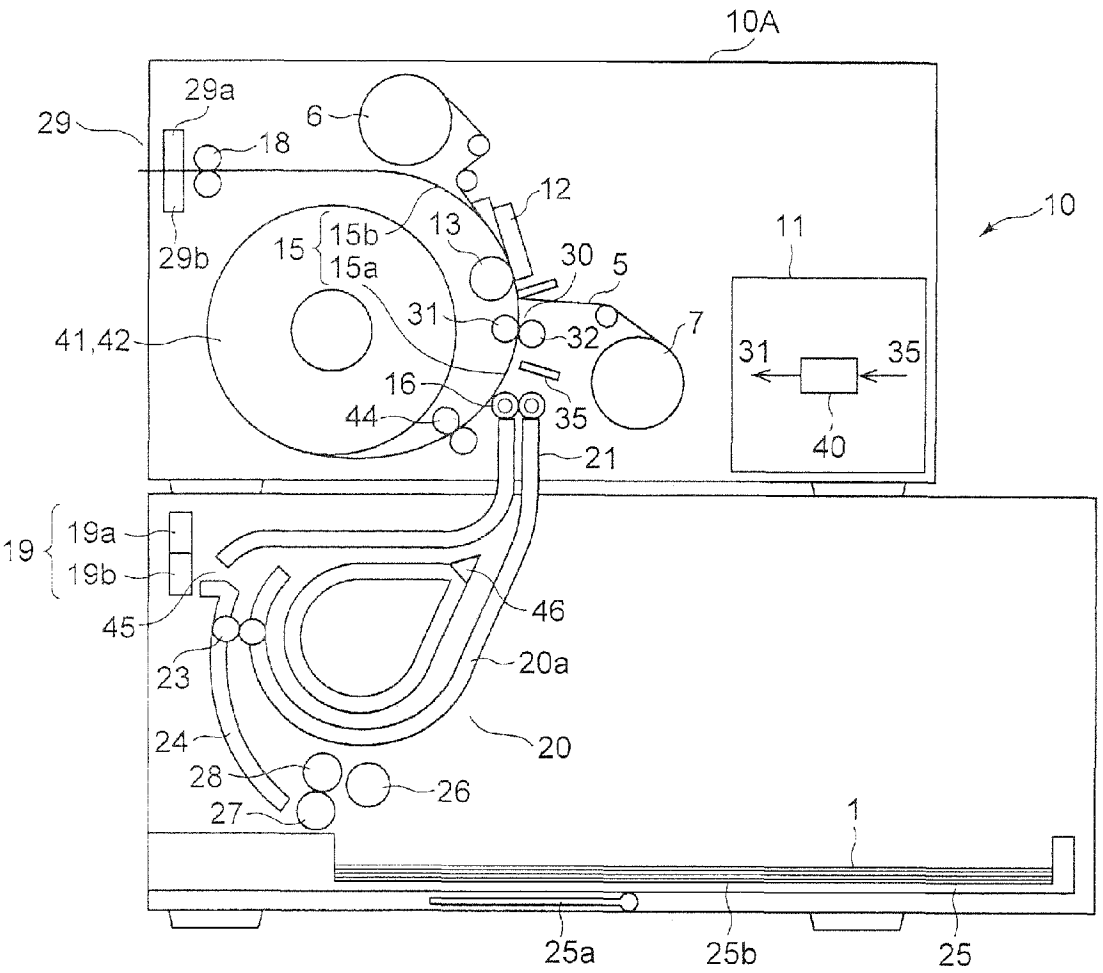
FIG. 1 is a schematic side view of a simplex and duplex printer according to an embodiment of the present invention.

FIG. 1 is a schematic side view of the simplex and duplex printer, and FIGS. 2 through 10 are diagrams illustrating the action of the simplex and duplex printer.

Figure 2:
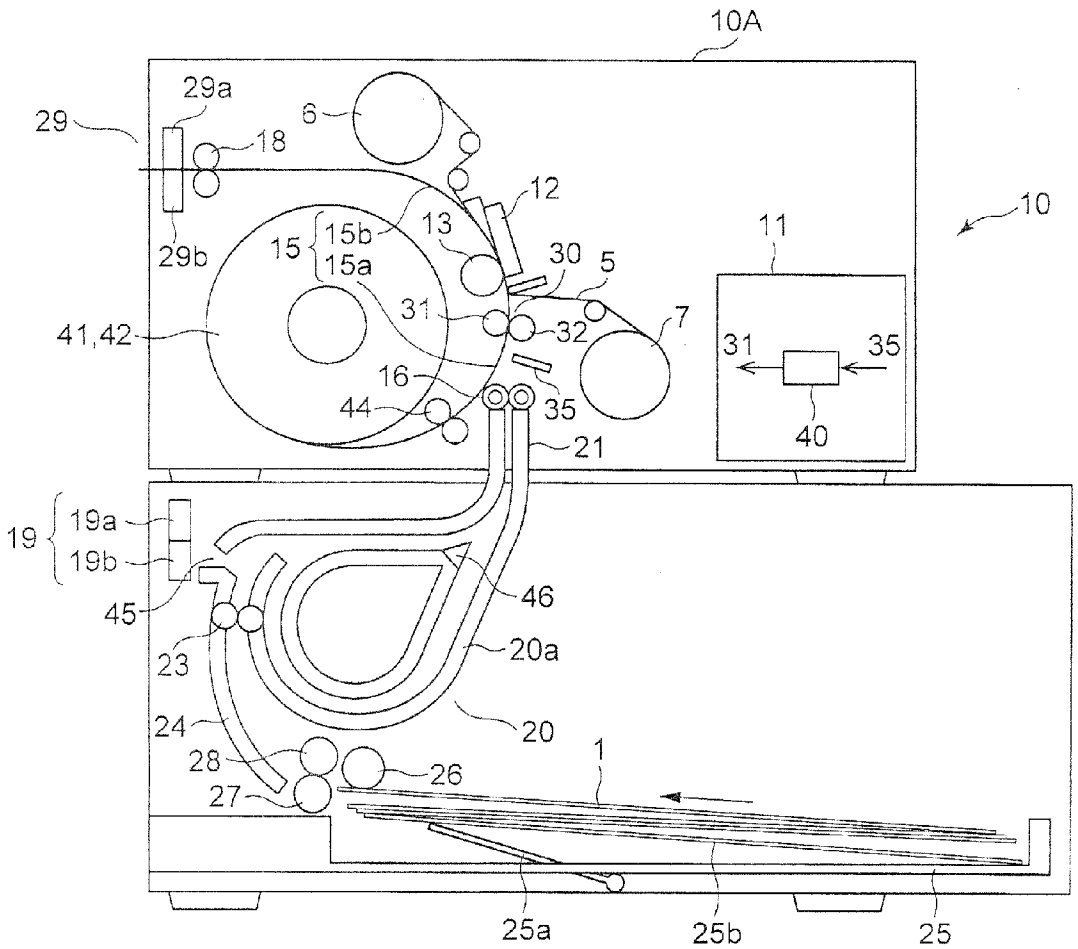
FIG. 2 is a diagram illustrating the action of the simplex and duplex printer according to the present invention.

As shown in FIGS. 1 and 2, the simplex and duplex printer 10 is a dye sublimation printer which transports a sheet-like substrate 1 having a receptive layer on both sides and performs duplex printing on the sheet-like substrate 1 by means of a printing section comprised of a thermal head 12, and which transports a continuous substrate 41 having a receptive layer at least on one side and performs simplex printing on the continuous substrate 41 by means of the printing section comprised of the thermal head 12.

The simplex and duplex printer 10 includes the printing section comprised of the thermal head 12, a rolled substrate supply section 42 for supplying a continuous substrate 41, which is to be printed on one side, from a roll of the substrate 41 to the thermal head 12, and a sheet-like substrate supply section 25, provided below the rolled substrate supply section 42, for storing sheet-like substrates 1 which are to be printed on both sides, and sequentially supplying the sheet-like substrates 1 to the thermal head 12.

The simplex and duplex printer 10 further includes a reversing mechanism 20 disposed between the thermal head 12 and the sheet-like substrate supply section 25. The reversing mechanism 20 is configured to reverse a sheet-like substrate 1, which has been returned from the thermal head 12 to the reversing mechanism 20, so that the thermal head 12-facing surface changes from one surface 1*a* to the other surface 1*b*.

The reversing mechanism 20 is disposed just below the rolled substrate supply section 42, and the sheet-like substrate supply section 25 is disposed below the reversing mechanism 20. The simplex and duplex printer 10 therefore has a compact structure as a whole.

Of the above components, the rolled substrate supply section 42 and the thermal head 12 may be existing ones. By disposing the reversing mechanism 20 and the sheet-like substrate supply section 25 below the existing rolled substrate supply section 42, the simplex and duplex printer 10 according to the present invention can be produced at a low cost with the use of the existing rolled substrate supply section 42 and thermal head 12.

A one-side substrate transport path 15*a* is provided on the entrance side of the thermal head 12, while an other-side substrate transport path 15*b* is provided on the exit side of the thermal head 12. The one-side substrate transport path 15*a* and the other-side substrate transport path 15*b* constitute a substrate transport path 15.

A platen roller 13 for holding a sheet-like substrate 1 or the continuous substrate 41 is provided on the opposite side of the sheet-like substrate 1 or the continuous substrate 41 from the thermal head 12.

The above-described reversing mechanism 20 is connected to the one-side substrate transport path 15*a* of the substrate transport path 15, and reverses a sheet-like substrate 1 so that the thermal head-facing surface changes from the one surface 1*a* to the other surface 1*b* while allowing the sheet-like substrate 1 to travel in one direction. The reversing mechanism 20 is comprised of a looped reversing transport path 20*a* which is connected at an end portion 21 to the one-side substrate transport path 15*a*.

The end portion 21 of the looped reversing transport path 20*a* functions as the entrance and the exit of the looped reversing transport path 20*a*.

A guide transport path 24 for guiding a sheet-like substrate 1, which has been supplied from the sheet-like substrate supply section 25, to the looped reversing transport path 20*a* is provided between the sheet-like substrate supply section 25 and the looped reversing transport path 20*a*. Transport rollers 23 are provided at the looped reversing transport path 20*a*-side end of the guide transport path 24.

Below the sheet-like substrate supply section 25 is provided a pick-up lever 25*a* for picking up the sheet-like substrates 1 which are placed on a lifting plate 25*b* in the sheet-like substrate supply section 25. Of the sheet-like substrates 1 which have been raised by the pick-up lever 25*a*, the top sheet-like substrate 1 is fed by a pick-up roller 26 to the guide transport path 24.

In particular, a separation roller 27 and a sheet feeding roller 28 are provided at the entrance to the guide transport path 24. The top sheet-like substrate 1 of the sheet-like substrates 1 which have been raised by the pick-up lever 25*a* is fed by the pick-up roller 26 to the separation roller 27 and the sheet feeding roller 28. It is possible that a sheet-like substrate 1, lying under the top sheet-like substrate 1, may be fed together with the top sheet-like substrate 1 toward the separation roller 27 and the sheet feeding roller 28. In that case, however, the sheet-like substrate 1 under the top sheet-like substrate 1 comes into contact with the separation roller 27 and will not be fed to the guide transport path 24.

The one-side substrate transport path 15*a* of the substrate transport path 15 is provided with transport rollers 16 and a substrate transport mechanism 30, with the transport rollers 16 being connected to the looped reversing transport path 20*a*. An end detection sensor 35 for detecting the ends 1A, 1B of a sheet-like substrate 1 is installed between the substrate transport mechanism 30 and the transport rollers 16. The substrate transport mechanism 30 consists of a friction roller 31 and a pinch roller 32, as will be described later.

Discharge rollers 18 are provided at the exit of the other-side substrate transport path 15*b*, and a cutter 29 for cutting the continuous substrate 41 is installed on the exit side of the discharge rollers 18.

The cutter 29 is to remove the front and rear margins of the continuous substrate 41 after printing, and consists of a fixed blade 29*b* and a movable blade 29*a* for cutting the continuous substrate 41 between it and the fixed blade 29*b*.

An outlet opening 45 for discharging a sheet-like substrate 1 from the looped reversing transport path 20*a* is provided between the looped reversing transport path 20*a* and the guide transport path 24. A cutter 19 for cutting the sheet-like substrate 1 is installed on the exit side of the outlet opening 45. The cutter 19 is to remove the front and rear margins of the sheet-like substrate 1 after printing, and consists of a fixed blade 19*b* and a movable blade 19*a* for cutting the sheet-like substrate 1 between it and the fixed blade 29*b*.

A sublimation transfer ribbon 5 for performing sublimation transfer is supplied from a ribbon unwinding section 6 to the thermal head 12 as a printing section. The ribbon 5 supplied from the ribbon unwinding section 6 is used in sublimation transfer printing performed by the thermal head 12. The used ribbon 5 after the printing is rewound in a ribbon rewinding section 7.

The looped reversing transport path 20*a* of the simplex and duplex printer 10 has a circular shape as a whole, and is disposed just below and vertically side-by-side with the rolled substrate supply section 42.

The looped reversing transport path 20*a* can thus be compactly disposed below the rolled substrate supply section 42.

The above-described components, such as the substrate transport mechanism 30, the rolled substrate supply section 42, the thermal head 12, the ribbon unwinding section 6, the ribbon rewinding section 7, the transport rollers 16, the discharge rollers 18, the cutter 19, the cutter 29, the pick-up lever 25*a*, the pick-up roller 26, the separation roller 27 and the sheet feeding roller 28, are all drive-controlled by a control device 11. All of the components and the control device 11 are housed in a chassis 10A.

The control device 11 includes a transport mechanism drive-control section 40 for drive-controlling the substrate transport mechanism 30 with high accuracy to carry out high-accuracy multi-color printing with the thermal head 12. The transport mechanism drive-control section 40 will be described later.

The substrate transport mechanism 30 for transporting a sheet-like substrate 1 and the end detection sensor 35 will now be described in detail.

As shown in FIG. 1, the one-side substrate transport path 15*a* of the substrate transport path 15 is provided with the substrate transport mechanism 30 for transporting a sheet-like substrate 1 and the end detection sensor 35, which are disposed between the thermal head 12 and the transport rollers 16, with the substrate transport mechanism 30 lying nearer to the thermal head 12.

The substrate transport mechanism 30 comprises a friction roller 31 and a pinch roller 32 for pressing a sheet-like substrate 1 against the friction roller 31.

The end detection sensor 35, located adjacent to the transport roller 16 side of the substrate transport mechanism 30, can detect the ends 1A, 1B of a sheet-like substrate 1. A detection signal from the end detection sensor 35 is sent to the transport mechanism drive-control section 40. Based on the signal from the end detection sensor 35, the transport mechanism drive-control section 40 drive-controls the friction roller 31 to perform positional adjustment of the ends 1A, 1B of a sheet-like substrate 1, thereby enabling high-accuracy multi-color printing with the thermal head 12.

The operation of the simplex and duplex printer 10 of this embodiment, having the above-described construction, will now be described with reference to FIGS. 1 through 10.

A description is first given of simplex printing on the continuous substrate 41, supplied from the rolled substrate supply section 42, performed by the thermal head 12 as shown in FIG. 1.

First, the continuous substrate 41 is unwound from the rolled substrate supply section 42 and fed on the substrate transport path 15 toward the discharge rollers 18.

Next, printing by sublimation transfer is performed by the thermal head 12 on one surface of the continuous substrate 41

In particular, the continuous substrate 41, whose front end has been discharged to the outside of the discharge rollers 18, is transported in the opposite direction by the rolled substrate supply section 42 and the discharge rollers 18 and returned toward the rolled substrate supply section 42. At the same time, the sublimation transfer ribbon 5 is supplied from the ribbon unwinding section 6 to the thermal head 12. A dye or pigment, contained in the ribbon 5, can be transferred onto one surface of the continuous substrate 41 by the heat from the thermal head 12.

The sublimation transfer ribbon 5 has Y (yellow), M (magenta), C (cyan) and OP (overcoat) regions. Y printing is first performed by the Y region of the ribbon 5.

In this manner, Y printing is performed on the one surface of the continuous substrate 41 with the sublimation transfer ribbon 5 in the thermal head 12. The continuous substrate 41 after the Y printing is again fed on the substrate transport path 15 toward the discharge rollers 18.

Thereafter, while returning the continuous substrate 41 toward the rolled substrate supply section 42 as in the Y printing, M printing and C printing are sequentially performed on the one surface of the continuous substrate 41 with the sublimation transfer ribbon 5 in the thermal head 12. After completion of the multi-color printing, an overcoat layer is formed on the one surface of the continuous substrate 41.

The continuous substrate 41 after the simplex printing is fed on the other-side substrate transport path 15*b* of the substrate transport path 15 toward the discharge rollers 18. The non-printed front margin of the continuous substrate 41 is then removed by the cutter 29.

The continuous substrate 41 is discharged by the discharge rollers 18 to the outside, and then the rear margin of the continuous substrate 41 is removed by the cutter 29.

The entirely printed substrate 41, which has undergone the simplex printing and the removal of the front and rear margins, is discharged by the discharge rollers 18 to the outside and taken out as a product.

Duplex printing on a sheet-like substrate 1, supplied from the sheet-like substrate supply section 25, performed by the thermal head 12 will now be described with reference to FIGS. 2 through 10.

As shown in FIG. 2, a number of sheet-like substrates 1 are stacked in the sheet-like substrate supply section 25.

First, the pick-up lever 25*a* raises the lifting plate 25*b* in the sheet-like substrate supply section 25, thereby raising the sheet-like substrates 1 placed on the lifting plate 25*b*.

Thereafter, the top sheet-like substrate 1 of the sheet-like substrates 1 on the lifting plate 25*b* is fed by the pick-up roller 26 to the separation roller 27 and the sheet feeding roller 28.

The transport rollers 23 near the looped reversing transport path 20*a* then rotate in synchronization with the pick-up roller 26, the separation roller 27 and the sheet feeding roller 28.

Figure 3:
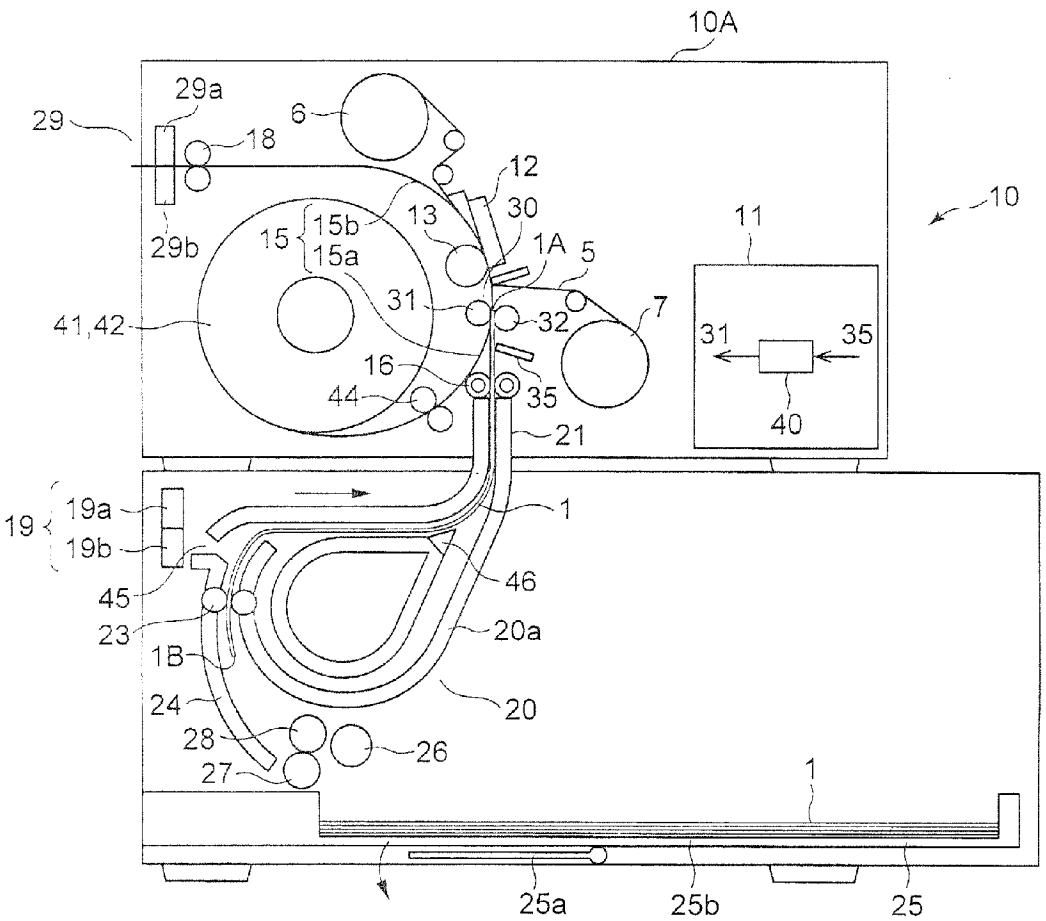
FIG. 3 is a diagram illustrating the action of the simplex and duplex printer according to the present invention.

The sheet-like substrate 1, which has been fed by the pick-up roller 26 to the separation roller 27 and the sheet feeding roller 28, is fed to the looped reversing transport path 20*a* via the guide transport path 24, as shown in FIG. 3. It is possible that a sheet-like substrate 1, lying under the top sheet-like substrate 1 of the sheet-like substrates 1 in the sheet-like substrate supply section 25, may also be fed together with the top sheet-like substrate 1 toward the separation roller 27 and the sheet feeding roller 28. In that case, however, the sheet-like substrate 1 under the top sheet-like substrate 1 comes into contact with the separation roller 27. Thus, only the top sheet-like substrate 1 is fed to the guide transport path 24 and then to the looped reversing transport path 20*a*.

When the rear end 1B of the sheet-like substrate 1 is detected by a detection sensor (not shown) provided in the guide transport path 24, the pick-up lever 25*a* is lowered to lower the lifting plate 25*b* and the sheet-like substrates 1 on it in the sheet-like substrate supply section 25 (see FIG. 3).

The sheet-like substrate 1 in the looped reversing transport path 20*a* is fed by the transport rollers 16 and the transport mechanism 30 to the substrate transport path 15 via a route switching plate 46 and the end portion 21.

The sheet-like substrate 1 is pressed by the pinch roller 32 against the friction roller 31 in the transport mechanism 30. Therefore, when the friction roller 31 is driven by the drive-control section 40, the sheet-like substrate 1 can be securely transported by the frictional force generated between it and the friction roller 31. Further, unlike a transport roller having surface microprotrusions which are caused to dig into a sheet-like substrate, the friction roller 31 will not cause damage to the sheet-like substrate 1.

As described later, both surfaces of the sheet-like substrate 1 are to come into contact with the friction roller 31 of the transport mechanism 30. The friction roller 31, which transports the sheet-like substrate 1 by the frictional force, does not cause damage to both surfaces of the sheet-like substrate 1, thereby enabling appropriate printing to be performed on both surfaces of the sheet-like substrate 1.

The sheet-like substrate 1 is fed on the substrate transport path 15 toward the discharge rollers 18.

On the other hand, the pick-up roller 26, the separation roller 27 and the sheet feeding roller 28 are all stopped.

Figure 4:
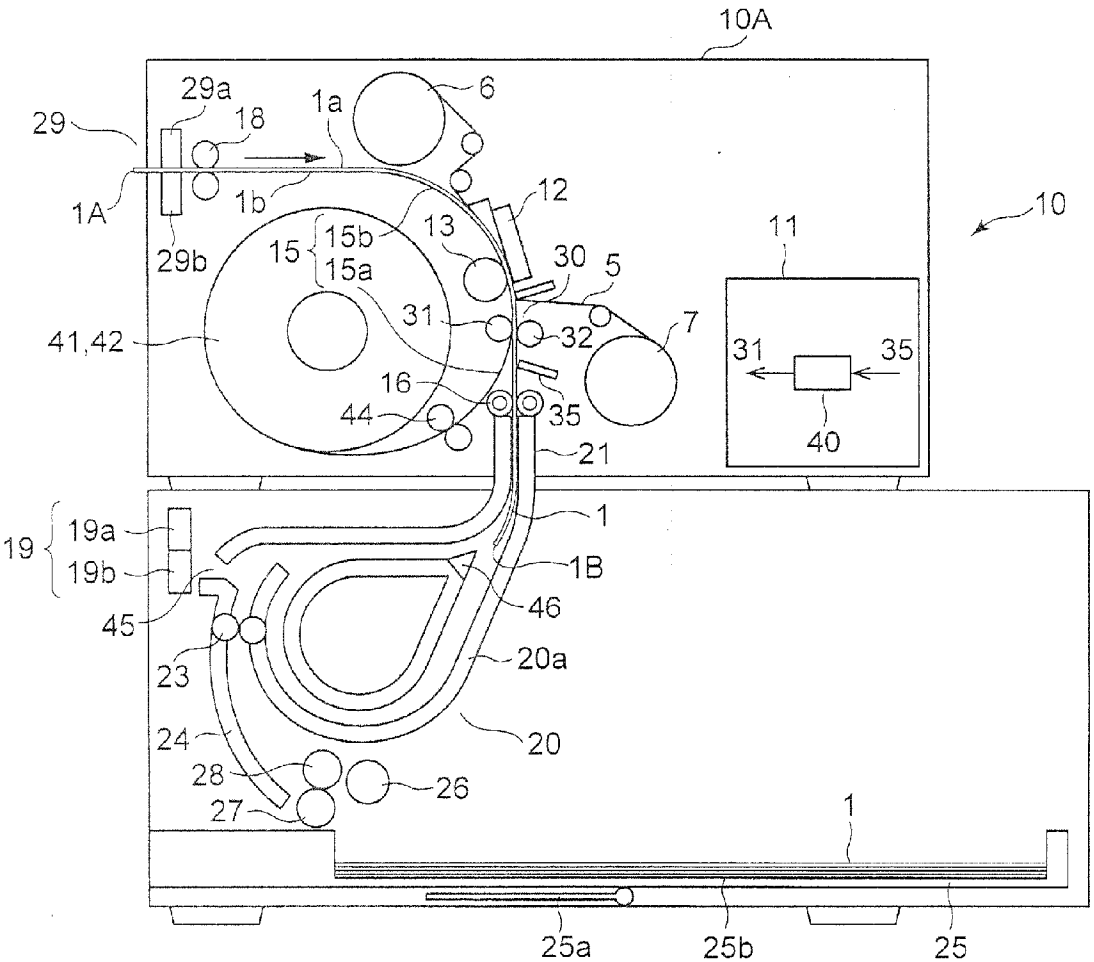
FIG. 4 is a diagram illustrating the action of the simplex and duplex printer according to the present invention.

Next, as shown in FIG. 4, printing by sublimation transfer is performed by the thermal head 12 on one surface la of the sheet-like substrate 1.

In particular, the sheet-like substrate 1, whose front end has been discharged to the outside of the discharge rollers 18, is transported in the opposite direction by the discharge rollers 18 and fed in the direction from the other-side substrate transport path 15*b* of the substrate transport path 15 toward the one-side substrate transport path 15*a* by the transport rollers 16 and the substrate transport mechanism 30. At the same time, the sublimation transfer ribbon 5 is supplied from the ribbon unwinding section 6 to the thermal head 12. A dye or pigment, contained in the ribbon 5, can be transferred onto the one surface 1*a* of the sheet-like substrate 1 by the heat from the thermal head 12.

The sublimation transfer ribbon 5 has Y (yellow), M (magenta), C (cyan) and OP (overcoat) regions. Y printing is first performed by the Y region of the ribbon 5.

In this manner, Y printing is performed on the one surface 1*a* of the sheet-like substrate 1 with the sublimation transfer ribbon 5 in the thermal head 12. The sheet-like substrate 1 after the Y printing is fed to the one-side substrate transport path 15*a* of the substrate transport path 15, and enters the looped reversing transport path 20*a* from the end portion 21 which functions as the entrance and the exit of the looped reversing transport path 20*a*.

Figure 5:
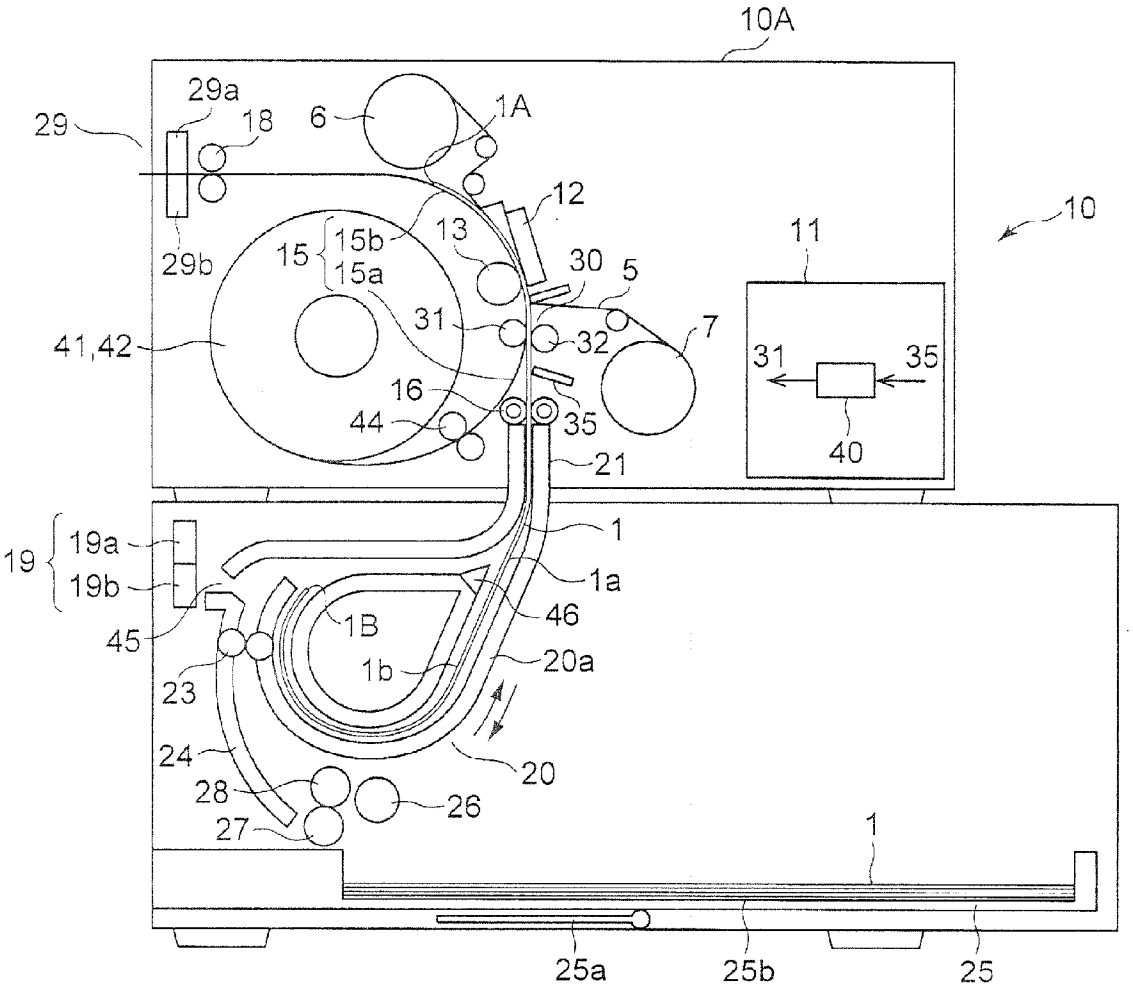
FIG. 5 is a diagram illustrating the action of the simplex and duplex printer according to the present invention.

As shown in FIG. 5, the sheet-like substrate 1 in the looped reversing transport path 20*a* is again fed to the one-side substrate transport path 15*a* of the substrate transport path 15 and then to the other-side substrate transport path 15*b*. Thereafter, in the same manner as described above, M printing and C printing are sequentially performed on the one surface la of the sheet-like substrate 1 with the sublimation transfer ribbon 5 in the thermal head 12. After completion of the multi-color printing, an overcoat layer is formed on the one surface la of the sheet-like substrate 1.

As described above, the sheet-like substrate 1, whose front end has been discharged to the outside of the discharge rollers 18, is transported by the transport mechanism 30 in the direction from the other-side substrate transport path 15*b* toward the one-side substrate transport path 15*a*, and Y printing, M printing and C printing are sequentially performed and then an overcoat layer is formed on the one surface 1*a* of the sheet-like substrate 1 by means of the thermal head 12.

When the sheet-like substrate 1 is transported by the transport mechanism 30 in the direction from the other-side substrate transport path 15*b* toward the one-side substrate transport path 15*a*, the front end 1B of the sheet-like substrate 1 is detected by the end detection sensor 35, and a detection signal from the end detection sensor 35 is sent to the transport mechanism drive-control section 40. Based on the signal from the end detection sensor 35, the transport mechanism drive-control section 40 can drive-control the friction roller 31 to perform positional adjustment of the front end 1B of the sheet-like substrate 1.

In this regard, it is possible that during transport of the sheet-like substrate 1 by the transport mechanism 30, slight slipping may occur between the friction roller 31 and the sheet-like substrate 1, resulting in a small positional displacement therebetween.

In that case, the transport mechanism drive-control section 40 can control the drive of the friction roller 31 based on a signal from the end detection sensor 35, thereby adjusting the position of the front end 1B of the sheet-like substrate 1. Such positional control of the sheet-like substrate 1 by the drive-control section 40 is performed every time the respective-color printing (Y printing, M printing, C printing) is performed or an overcoat layer is formed. This makes it possible to securely perform positional control of the sheet-like substrate 1, thereby enabling high-accuracy multi-color printing with the thermal head 12.

Multi-color printing of the one surface is of the sheet-like substrate 1 by sublimation transfer is performed in the above-described manner by means of the thermal head 12.

Figure 6:
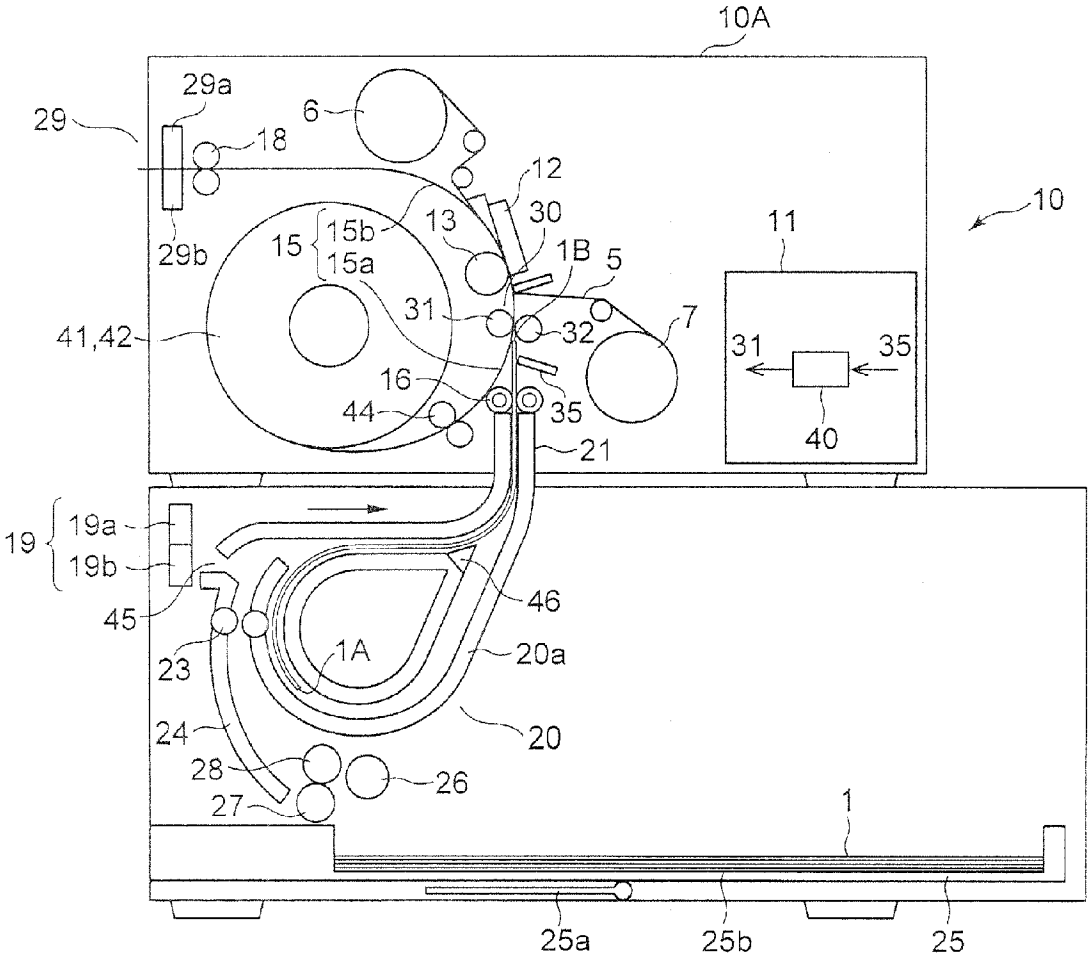
FIG. 6 is a diagram illustrating the action of the simplex and duplex printer according to the present invention.

After completion of the multi-color printing, a reversing operation for the sheet-like substrate 1 is performed in the looped reversing transport path 20*a*, as shown in FIG. 6.

In particular, the sheet-like substrate 1 after the printing of the one surface la is fed into the looped reversing transport path 20*a*, and travels in one direction in the looped reversing transport path 20*a* by means of the transport rollers 23 (see FIG. 6).

The sheet-like substrate 1 is reversed while it is traveling in one direction in the looped reversing transport path 20*a*. Thus, the thermal head 12-facing surface changes from the one surface is to the other surface 1*b*.

As shown in FIG. 6, the reversed sheet-like substrate 1 then enters the one-side substrate transport path 15*a* of the substrate transport path 15 via the end portion 21.

Thereafter, the sheet-like substrate 1 is fed on the other-side substrate transport path 15*b* of the substrate transport path 15 toward the discharge rollers 18. The reversing operation for the sheet-like substrate 1 is thus completed.

Figure 7:
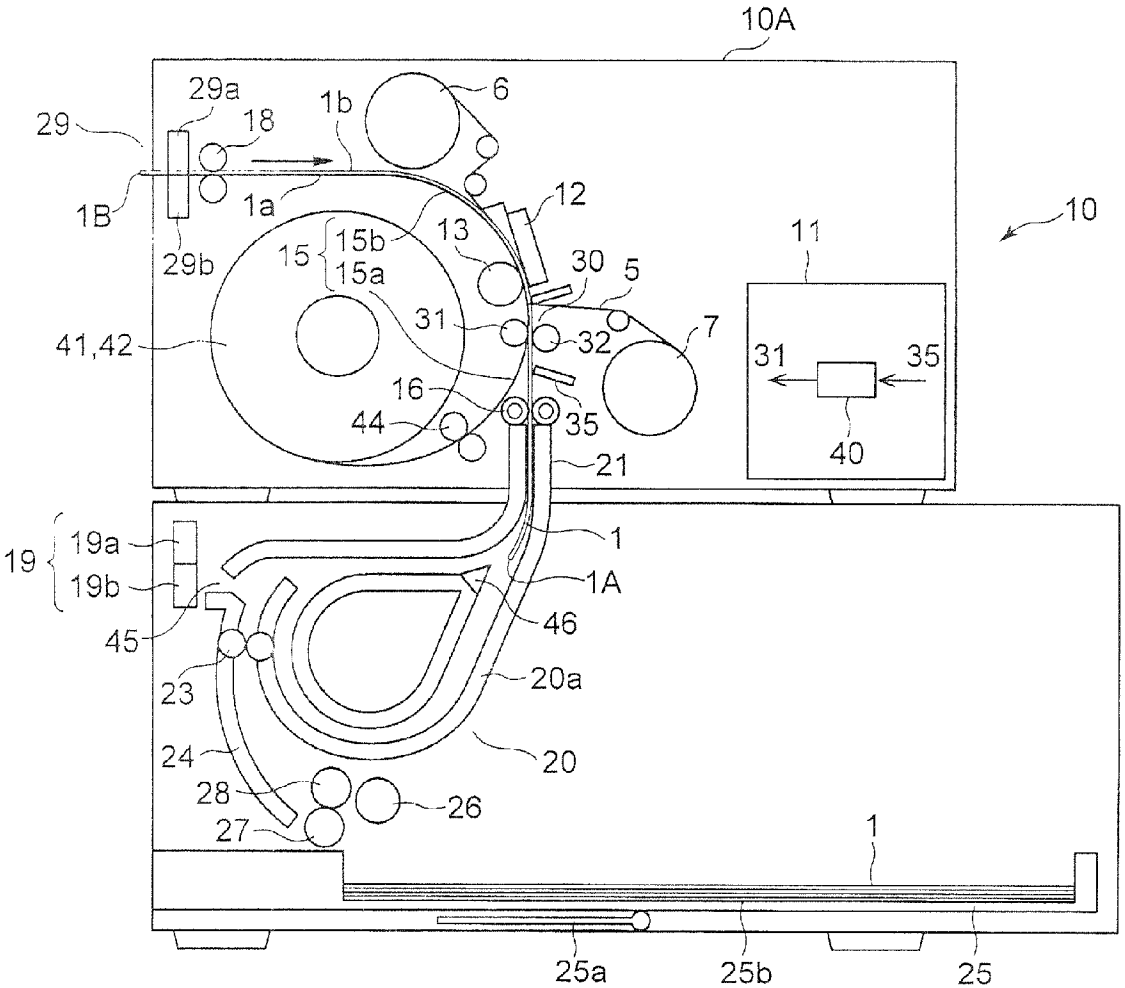
FIG. 7 is a diagram illustrating the action of the simplex and duplex printer according to the present invention.

Thereafter, as shown in FIG. 7, Y printing is performed on the other surface 1*b* of the sheet-like substrate 1 with the sublimation transfer ribbon 5 in the thermal head 12 in the same manner as described above.

Figure 8:
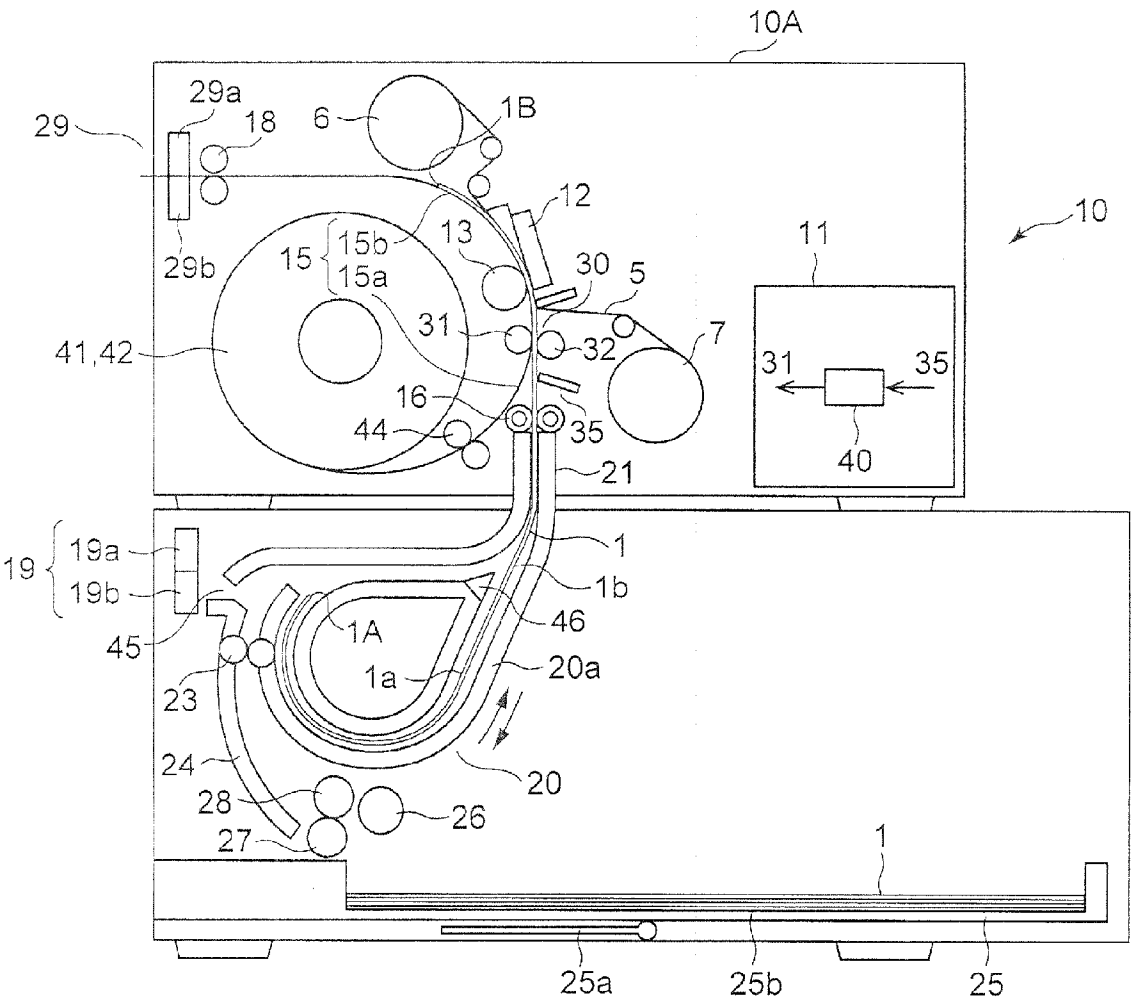
FIG. 8 is a diagram illustrating the action of the simplex and duplex printer according to the present invention.
Figure 9:
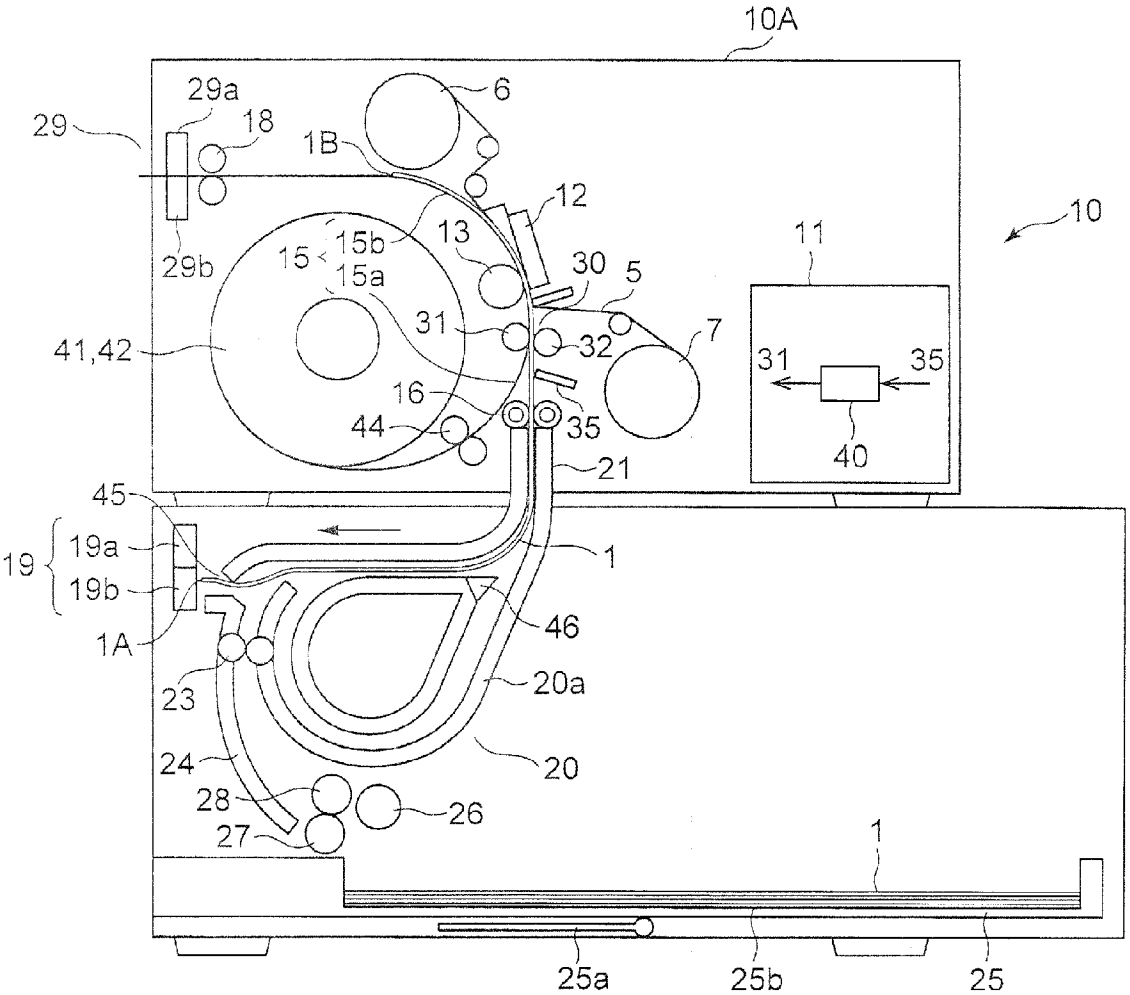
FIG. 9 is a diagram illustrating the action of the simplex and duplex printer according to the present invention.

Thereafter, as shown in FIG. 8, M printing and C printing are sequentially performed and then an overcoat layer is formed on the other surface 1*b* of the sheet-like substrate 1 with the sublimation transfer ribbon 5. Multi-color printing of the other surface 1*b* of the sheet-like substrate 1 is thus completed.

Next, the sheet-like substrate 1 after the duplex printing of the both surfaces 1*a*, 1*b* is fed on the other-side substrate transport path 15*b* of the substrate transport path 15 toward the discharge rollers 18.

Thereafter, the sheet-like substrate 1 is returned from the discharge rollers 18 and enters the looped reversing transport path 20*a* in which the route switching plate 46 has previous been switched. The sheet-like substrate 1 travels on the switched route toward the outlet opening 45 in the looped reversing transport path 20*a*. The non-printed front margin of the sheet-like substrate 1 is then removed by the cutter 19 (see FIG. 9).

Figure 10:
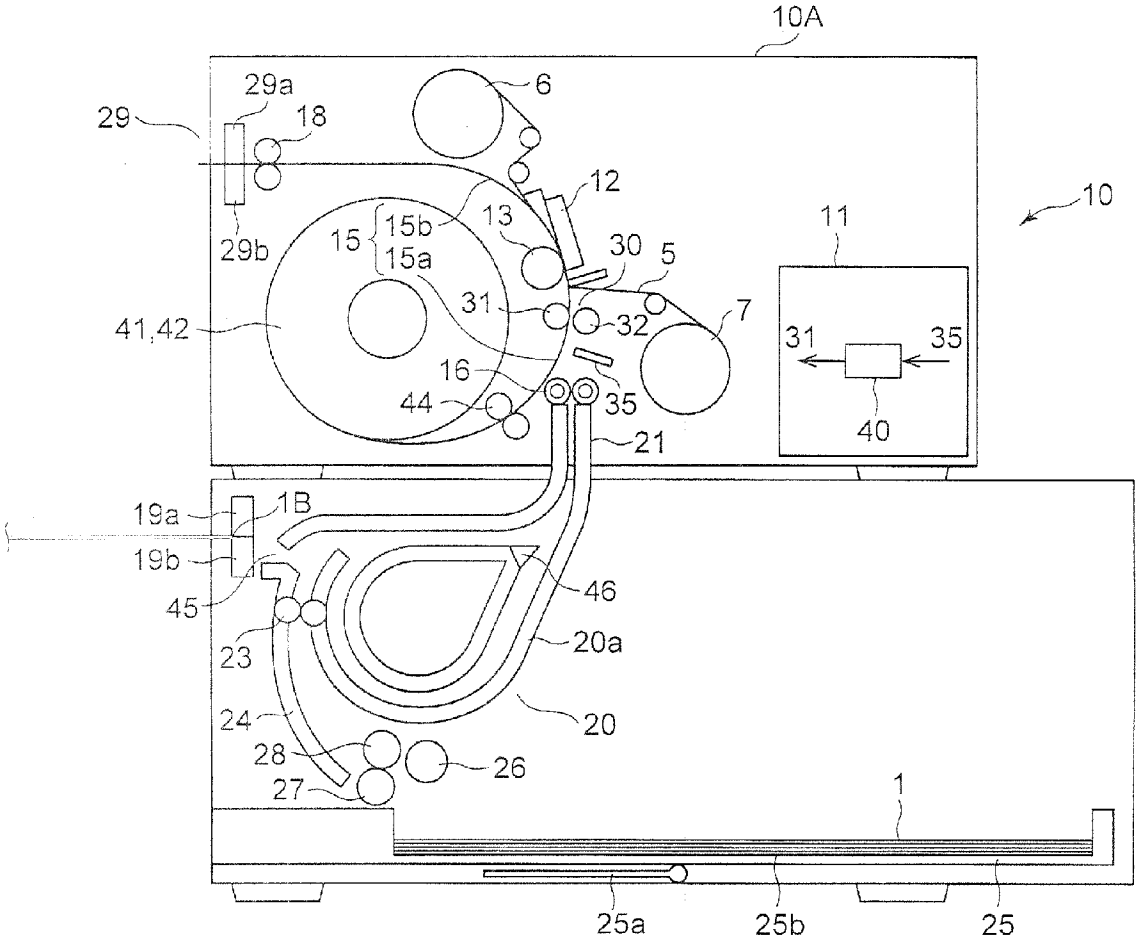
FIG. 10 is a diagram illustrating the action of the simplex and duplex printer according to the present invention.

The sheet-like substrate 1 is discharged from the outlet opening 45, and the rear margin of the sheet-like substrate 1 is removed by the cutter 19 (see FIG. 10).

The entirely printed sheet-like substrate 1, which has undergone the duplex printing of the one surface 1*a* and the other surface 1*b* and the removal of the front and rear margins, is thus discharged to the outside and taken out as a product.

As described hereinabove, according to the printer of this embodiment, sublimation transfer printing can be easily performed by means of the thermal head 12 on one surface of the continuous substrate 41 unwound from the rolled substrate supply section 42. Further, a sheet-like substrate 1 can be easily and securely reversed simply by allowing it to travel in one direction in the looped reversing transport path 20*a* of the reversing mechanism 20. Sublimation transfer printing can be easily performed by means of the thermal head 12 on both surfaces 1*a*, 1*b* of the thus-reversed sheet-like substrate 1.

The reversing mechanism 20, comprised of the looped reversing transport path 20*a*, has a circular shape as a whole and, in addition, the reversing mechanism 20 and the sheet-like substrate supply section 25 are disposed below the rolled substrate supply section 42. The simplex and duplex printer 10 can therefore have a compact construction as a whole. Therefore, in the event of jamming of a sheet-like substrate 1, the location of the sheet-like substrate 1 in the interior of the chassis 10A can be easily found and the sheet-like substrate 1 can be easily taken out by opening the chassis 10A.

Furthermore, the simplex and duplex printer 10 can be produced easily at a low cost simply by utilizing the existing rolled substrate supply section 42 and the existing thermal head 12, and disposing the sheet-like substrate supply section 25 and the reversing mechanism 20 below the rolled substrate supply section 42.

Furthermore, the end detection sensor 35 detects the ends 1A, 1B of a sheet-like substrate 1 and, based on a detection signal from the end detection sensor 35, the drive-control section 40 drive-controls the friction roller 31 to perform positional adjustment of the sheet-like substrate 1. This enables high-accuracy multi-color printing of the sheet-like substrate 1 with the thermal head 12.

DESCRIPTION OF THE REFERENCE NUMERALS

1 sheet-like substrate
1*a* one surface
1*b* the other surface
5 sublimation transfer ribbon
6 ribbon unwinding section
7 ribbon rewinding section
10 simplex and duplex printer
10A chassis
11 control device
12 thermal head
13 platen roller
15 substrate transport path 15
15*a* one-side substrate transport path
15*b* other-side substrate transport path
16 transport roller
18 discharge roller
19 cutter
20 reversing mechanism
20*a* looped reversing transport path
21 end portion
23 transport roller
24 guide transport path
25 sheet-like substrate supply section
25*a* pick-up lever
26 pick-up roller
27 separation roller
28 sheet feeding roller
29 cutter
30 substrate transport mechanism
31 friction roller
32 pinch roller
40 drive-control section
41 continuous substrate
42 rolled substrate supply section
45 outlet opening
46 route switching plate

The invention claimed is:

1. A simplex and duplex printer comprising:
a printing section;
a rolled substrate supply section configured to supply a continuous substrate, which is to be printed on one side, from a roll of the substrate to the printing section;
a sheet-like substrate supply section, provided below the rolled substrate supply section, configured to store sheet-like substrates which are to be printed on both sides, and sequentially supplying the sheet-like substrates to the printing section;
a reversing mechanism, disposed between the printing section and the sheet-like substrate supply section, configured to reverse a sheet-like substrate, which has been returned from the printing section, so that the printing section-facing surface changes from one surface to the other surface; and
a continuous substrate cutter configured to cut the continuous substrate and provided on the exit side of the printing section.

2. The simplex and duplex printer according to claim 1, wherein the reversing mechanism reverses the sheet-like substrate, which has been returned from the printing section, while allowing the sheet-like substrate to travel in one direction.

3. The simplex and duplex printer according to claim 1, wherein the reversing mechanism is located just below the rolled substrate supply section.

4. A simplex and duplex printer comprising:
a printing section;
a rolled substrate supply section configured to supply a continuous substrate, which is to be printed on one side, from a roll of the substrate to the printing section;
a sheet-like substrate supply section, provided below the rolled substrate supply section, configured to store sheet-like substrates which are to be printed on both sides, and sequentially supplying the sheet-like substrates to the printing section; and
a reversing mechanism, disposed between the printing section and the sheet-like substrate supply section, configured to reverse a sheet-like substrate, which has been returned from the printing section, so that the printing section-facing surface changes from one surface to the other surface, wherein the reversing mechanism is provided with a sheet-like substrate cutter configured to cut the sheet-like substrate.

5. The simplex and duplex printer according to claim 4, wherein the reversing mechanism reverses the sheet-like substrate, which has been returned from the printing section, while allowing the sheet-like substrate to travel in one direction.

6. The simplex and duplex printer according to claim 4, wherein the reversing mechanism is located just below the rolled substrate supply section.

* * * * *